US005996255A

United States Patent [19]

Ventura

[11] Patent Number: 5,996,255

[45] Date of Patent: Dec. 7, 1999

[54] PUNCTURE RESISTANT INSOLE

[76] Inventor: George Ventura, 22825 W. 47th, Shawnee, Kans. 66226

[21] Appl. No.: 09/139,143

[22] Filed: Aug. 24, 1998

Related U.S. Application Data

[63] Continuation-in-part of application No. 08/933,721, Sep. 19, 1997, abandoned.

[51] Int. Cl.[6] ..... A43B 13/38; A43B 13/12

[52] U.S. Cl. ..... 36/44; 36/73; 36/30 R; 36/4

[58] Field of Search ..... 36/44, 73, 30 R, 36/102, 107, 108, 4, 72 A

[56] References Cited

U.S. PATENT DOCUMENTS

| | | |
|---|---|---|
| 2,495,045 | 1/1950 | Woodbury . |
| 2,865,097 | 12/1958 | Vollrath, Jr. et al. . |
| 4,651,445 | 3/1987 | Hannibal . |
| 5,390,430 | 2/1995 | Fitchmun et al. . |
| 5,804,757 | 9/1998 | Wynne . |
| 5,843,851 | 12/1988 | Cochran . |

FOREIGN PATENT DOCUMENTS

| | | |
|---|---|---|
| 6280 | 2/1895 | United Kingdom . |
| 97/04675 | 2/1997 | WIPO . |

*Primary Examiner*—Ted Kavanaugh
*Attorney, Agent, or Firm*—Litman, Kraai & Brown L.L.C

[57] ABSTRACT

An improved sole or insole for providing puncture resistance in boots and other types of shoes includes multiple layers of a tightly woven, puncture resistant fabric, formed from high tensile strength synthetic or polymeric fibers, such as Kevlar®, a polyaramid. The layers of puncture resistant fabric generally are not bonded together or adhered together by adhesives or the like. The layers of puncture resistant fabric may be secured together along the outer peripheries thereof, or they may be secured within a pocket formed from a covering material, such as foam, or in a pocket formed between an inner and outer sole of the boot or shoe.

4 Claims, 3 Drawing Sheets

Fig.4.
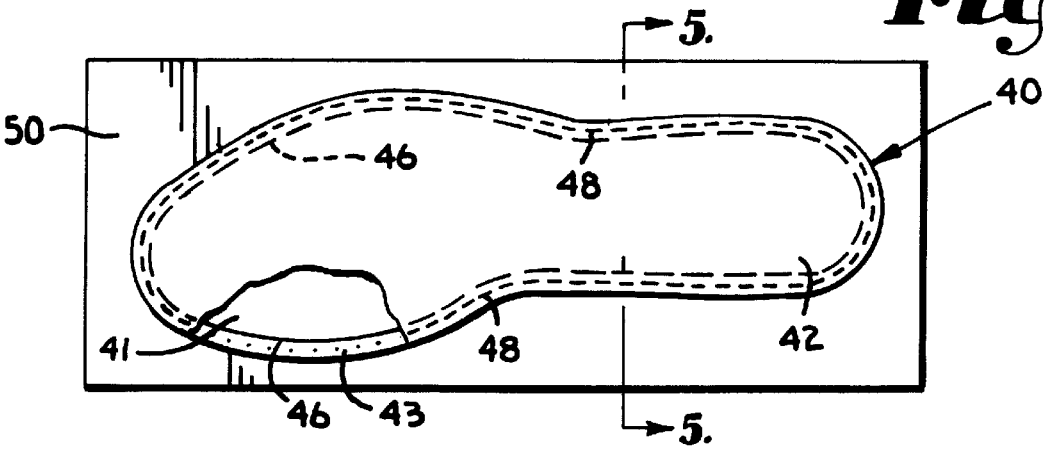
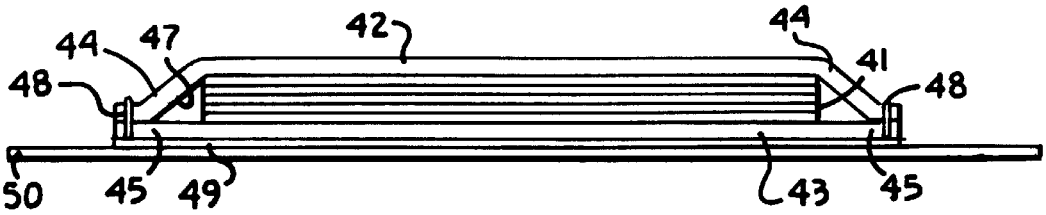
Fig.5.
Fig.6.
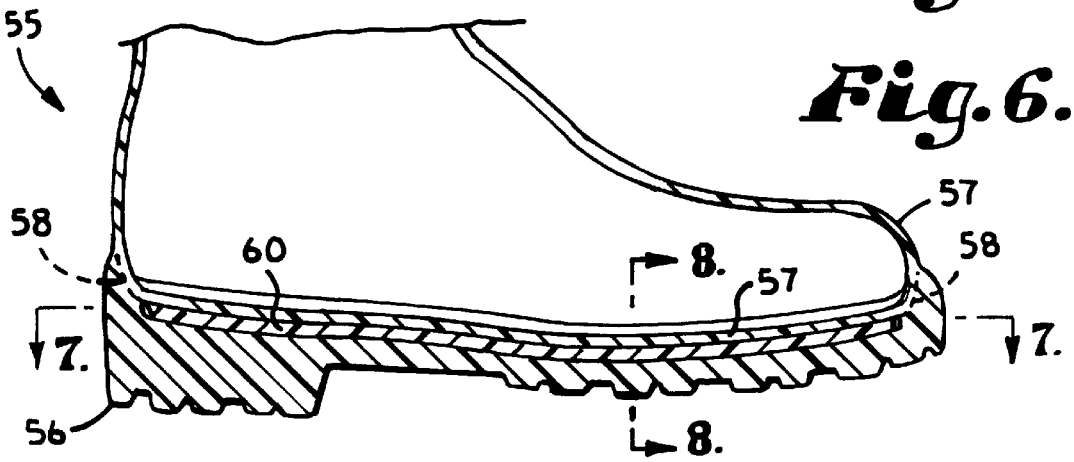
Fig.7.
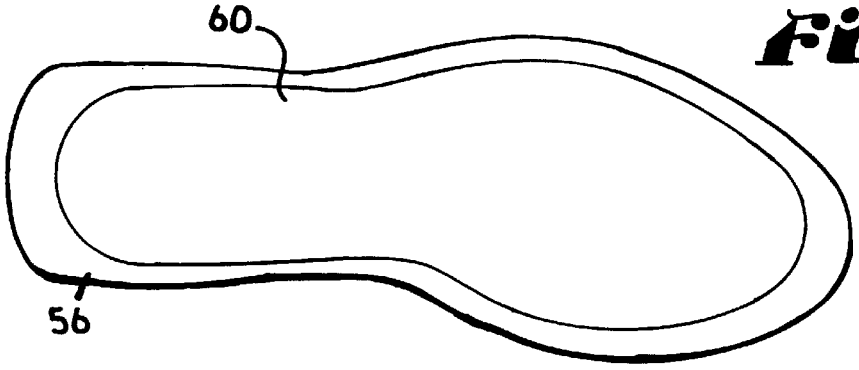

PUNCTURE RESISTANT INSOLE

CROSS REFERENCE TO RELATED APPLICATIONS

This application is a continuation-in-part of application for U.S. patent Ser. No. 08/933,721 entitled PUNCTURE RESISTANT INSOLE, filed Sep. 7, 1997 now abandoned.

BACKGROUND OF THE INVENTION

The present invention relates to puncture resistant insoles for boots and other shoes.

Manufacturing, construction and demolition sites are often full of sharp objects such as protruding nails which present a significant hazard to unwary workers. When stepped on, upturned nails in a board or the like easily penetrate the worker's boot and foot causing considerable pain and injury. Such a puncture wound can hobble a worker for weeks and requires particular medical attention to avoid tetanus or other anaerobic bacterial infections.

The current OSHA puncture hazard requirement is being met by the incorporation of a steel or metal insole in worker footwear. The use of metal insoles presents several problems and has several undesirable characteristics. In particular, metal is, by its nature, relatively inflexible and stiff. The use of footwear which is inflexible or stiff causes workers to be unable to flex their feet when walking, climbing, or working on difficult, uneven surfaces. As a result, the wearer is subject to falling, stumbling, and slipping. In short, there is a substantial loss of sure-footedness when wearing the present puncture resistant footwear.

The metal in currently available puncture resistant footwear conducts both electricity and heat. Workers who wear footwear containing a steel insole are, thus, more subject to frostbite when working in cold environments. Further, footwear with metal insoles cannot be worn by electrical workers. Instead, a non-conducting fiberglass insole is required for those engaged in electrical work. Fiberglass manufacturing processes, however, are subject to numerous environmental issues, which tend to increase the cost of fiberglass. Moreover, the fiberglass insole must be quite thick to provide the required puncture resistance, which reduces both the comfort and flexibility of the shoe.

Insoles have been developed which comprise multiple layers of stacked fibrous materials or fabric which are bonded together by synthetic resins and the like to form resin impregnated laminates. Fibrous materials previously identified as useable include spun glass fibers or nylon. Impregnation of the fabric is indicated as necessary to provide the desired puncture resistance. However, the resin impregnation process adds to the cost of materials and labor, reduces flexibility of the resulting insole and generally adds to the overall thickness of the insole.

Any puncture resistant insole which appreciably decreases the flexibility of the footwear or which is too thick is uncomfortable for workers to wear, and workers will remove the puncture resistant footwear when supervisors or regulators are not present. In addition, many workers wear the safety shoes only when doing jobs requiring the safety shoes and then change to more comfortable shoes when they are not needed. A more comfortable shoe would make these changes unnecessary and, as a consequence, reduce worker downtime.

There remains a need for a way to increase the puncture resistance of boots and the like without sacrificing comfort and flexibility or significantly increasing the weight of the boot.

SUMMARY OF THE INVENTION

The present invention comprises an improved sole or insole for a shoe including multiple layers of a tightly woven fabric formed from high tensile strength synthetic or polymeric fibers. Preferred fibers include polyaramid fibers, such as Kevlar® or Twaron® fibers of 200 denier fineness in a 70–70 weave. Kevlar is a registered trademark of E. I. du Pont de Nemours & Co. and Twaron is a registered trademark of Akzo Nobel Fibers B.V. It is foreseen that other high tensile strength synthetic fibers, such as Spectra®, a high molecular weight polyethylene, could be utilized. In one embodiment, an insole is utilized as a liner for insertion into an existing boot or other type of shoe to provide puncture resistance. In another embodiment, the layers of puncture resistant material are secured between an inner and outer layer of the sole of the shoe. The layers of puncture resistant fabric may be secured together along the outer peripheries thereof, or they may be secured within a pocket formed from a covering material, such as foam, leather, cotton or other fabrics. The layers of puncture resistant fabric may also be secured within a pocket formed between an inner and outer sole of the boot or shoe. The layers may also be secured within various enveloping materials or structures such as a shrink wrap plastic film. In the inventive insole, the fibers forming the layers of puncture resistant fabric are not impregnated by resins or adhesives since such impregnation is not required to provide structural support and to hold the fibers in place.

OBJECTS AND ADVANTAGES OF THE INVENTION

The objects of this invention include: to provide a boot or shoe which is puncture resistant; to provide a sole for boots or shoes which resists punctures; to provide such a sole which is relatively light weight; to provide such a sole without appreciably reducing shoe flexibility; to provide such a sole which is neither thermally or electrically conductive; to provide a puncture resistant insole for forming such a sole which is relatively thin; to provide such an insole which is relatively comfortable to use; to provide such an insole which may be purchased separately as an insert for an existing boot; to provide such an insole which does not slip when positioned within a boot; to provide such an insole which is relatively inexpensive to manufacture; and to provide such an insole which is particularly well adapted for its intended purposes thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 4 is a top plan view of a second embodiment of a puncture resistant insole of the present invention mounted on a card stock backing and with portions broken away to show interior detail.

FIG. 5 is an enlarged cross-sectional view taken along line 5—5 of FIG. 4.

FIG. 6 is a side elevational view of a third embodiment of the present invention incorporated in a boot and with portions broken away to show layers of puncture resistant fabric secured between an inner and outer sole of the boot.

FIG. 7 is a cross-sectional view taken generally along line 7—7 of FIG. 6.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
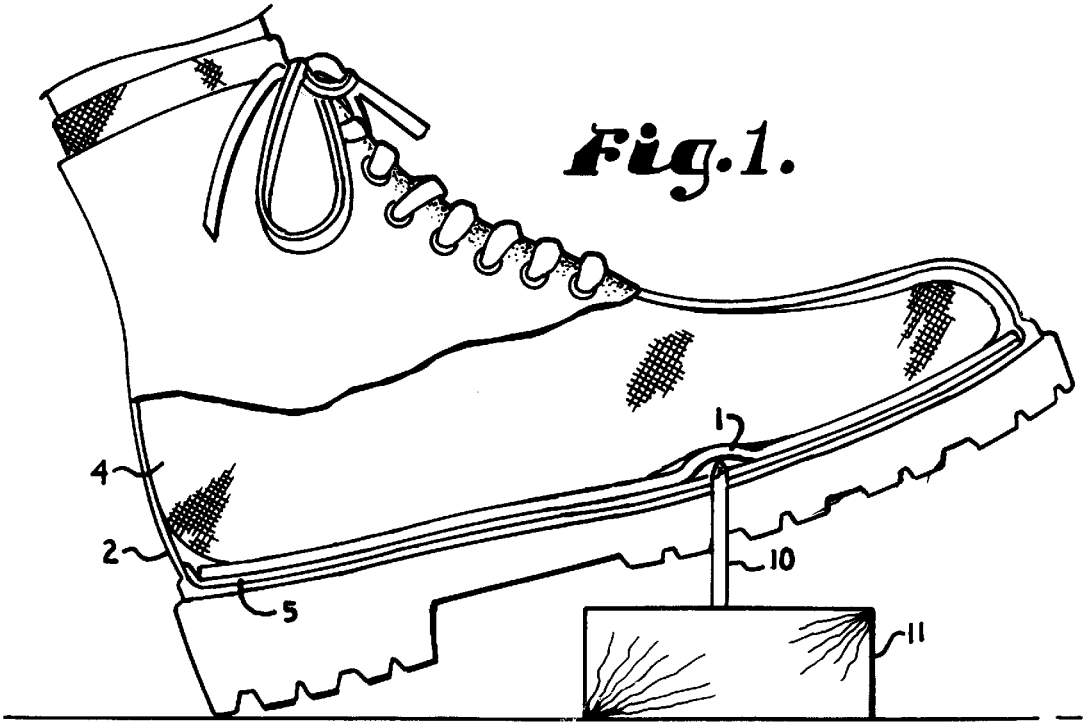
FIG. 1 is a fragmentary side view of a boot on a wearer's foot with portions of the boot removed to show an insole of the present invention positioned between the wearer's foot and the original standard insole of the boot and showing the puncture resistant insole preventing a puncture wound as the wearer steps on a nail.

Referring to the drawings in more detail, the reference numeral 1 refers to a puncture resistant insole of the present invention. The puncture resistant insole 1 is shown in FIG. 1 positioned in a boot 2 between the wearer's foot 4 and the original standard insole 5 of the boot 2. FIG. 1 shows the puncture resistant insole 1 preventing a nail 10 in a board 11 from penetrating into the foot 4 as the wearer steps onto the nail 10.

Figure 2:
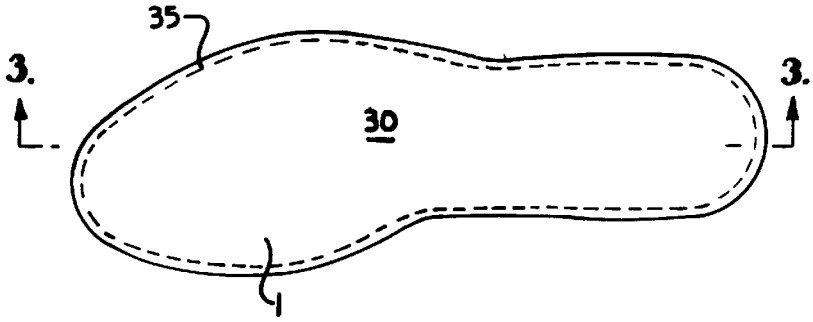
FIG. 2 is a top plan view of the puncture resistant insole.

FIG. 2 is a top plan view of the puncture resistant insole 1 of the present invention which is sized and shaped to generally conform to the shape of the bottom of a wearer's foot to provide protection substantially completely thereacross. The insoles 1 are shaped for both the left and right feet and in multiple sizes to conform to a wide range of foot sizes.

Figure 3:
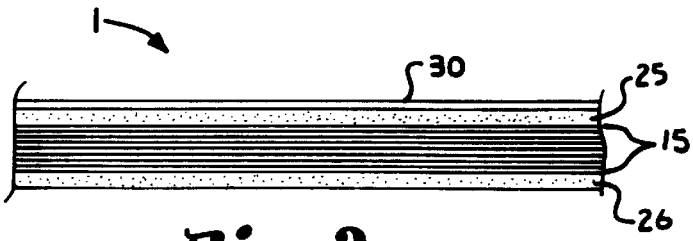
FIG. 3 is a greatly enlarged and fragmentary cross-sectional view of the puncture resistant insole taken along line 3—3 of FIG. 2 and with the relative thickness of the layers shown exaggerated for purposes of illustration.

As shown in FIG. 3, the insole 1 comprises a plurality of layers of puncture resistant fabric 15 secured between an upper and lower covering layer 25 and 26 preferably formed of foam. The puncture resistant fabric 15 is preferably formed from tightly woven high tensile strength synthetic or polymeric fibers such as polyaramid fibers sold under the trademark Kevlar®. It is foreseen that other high tensile strength synthetic fibers, such as a high molecular weight polyethylene sold under the trademark Spectra®, would be suitable for use in the present invention. A preferred puncture resistant fabric 15 is formed from 200 denier strands or threads of Kevlar® in a 70—70 weave (i.e. 70 threads per inch for both the warp and woof of the fabric). The insole 1 as shown in FIG. 3 comprises eight layers of the puncture resistant fabric 15 laid in vertical alignment on top of each other and each cut to conform to the shape of the bottom of a wearer's foot. The number of layers necessary to provide sufficient puncture resistance will depend in part on the weight of the wearer. It is believed that between three to ten layers of 70—70 weave, 200 denier Kevlar® fabric will be the preferred number of layers and more preferably five to eight layers thereof.

The upper layer of foam 25 preferably has a layer of cloth 30 secured thereto to reduce the amount of friction between the wearer's foot 4 and the insole 1 to provide more comfort. The upper layer of foam 25 and the layer of cloth 30 may be of the type used in commercially available insoles such as those sold under the mark Dr. Scholl's®. The lower layer of foam 26 is intended to prevent slipping between the insole 1 and the original insole 5 in the boot 2.

Referring to FIG. 2, reference numeral 35 refers to stitches to indicate that the various layers forming the insole 1 may be sewn together. However it is to be understood that, due to the puncture resistant nature of the fabric, the layers may be secured together by other means such as adhesives applied to the outer edges of each layer, by placing the layers of puncture resistant fabric 15 in a pocket or in an enveloping material as discussed in more detail below. It is to be understood that in the preferred embodiment, the layers of puncture resistant fabric 15 are simply laid on top of each other and secured together either at the outer periphery thereof of by securement in a pocket, envelope or the like. The adjacent layers of puncture resistant fabric 15 preferably are not bonded together across the interior thereof. However, it is foreseen that a light coating of an adhesive may be applied to both surfaces of each layer of puncture resistant fabric 15 and to the inner surfaces of the upper and lower foam layers 25 and 26 for securing the various layers together. However, it is to be understood that any such adhesive applied to the layers of puncture resistant fabric 15 is not intended to provide structure which provides puncture resistance or to form a puncture barrier, but merely for adhering or holding the layers of puncture resistant fabric 15 together. Further, such an adhesive is not intended to be applied in quantities sufficient to impregnate each layer of puncture resistant fabric 15.

It is also to be understood that the layers of puncture resistant fabric 15 are not used as a reinforcing fabric or mesh to provide reinforcement for a layer of resin, plastic, rubber or the like which may be generally be referred to hereinafter as resinous material. The layers of puncture resistant fabric 15 are not bonded together by resins which impregnate the fabric such that the resin extends through the interstices between the threads or strands forming the fabric to form a continuous resinous layer extending through the fabric.

It is foreseen that the insole 1 could be made solely of the layers of puncture resistant fabric 15. It is also foreseen that additional materials could be utilized with the layers of puncture resistant fabric 15 to provide additional comfort or enhancements. For example, the insoles could be provided with relatively rigid arch supports or a layer of material with odor absorbing properties. Further the upper and lower covering layers, could be formed from a wide range of materials other than foam including leather or cotton fabric. Further the foam layers could be formed around layers of puncture resistant fabric 15.

The insole 1 shown in FIGS. 1–3 generally comprises an insert for boots or other types of shoes which can be sold separately and inserted in existing boots or shoes to provide puncture resistance. However it is foreseen that an insole in accordance with the claims of the present invention could be used as the original insole provided with the boots or shoes. In particular, multiple layers of puncture resistant material could be secured to or within the materials used to form the insole which is provided with the boot or shoe. It is to be understood that the insole of the present invention could be used with almost any type of boot or shoe including work boots, hiking boots, athletic shoes or dress shoes. As used herein, the terms shoe and boot are interchangeable and would generally encompass any type of footwear.

FIGS. 4 and 5 show an alternative embodiment of the present invention comprising an insole 40 including multiple layers of puncture resistant fabric 41 secured between an upper layer of foam 42 and a lower layer of foam 43. The upper and lower layers of foam 42 and 43 are formed or cut slightly longer and wider than the layers of puncture resistant fabric 41. During construction of the insole 40, the layers of puncture resistant fabric 41 are aligned on top of each other and then positioned between the upper and lower layers of foam 42 and 43 such that outer peripheries 44 and 45 of the upper and lower layers of foam 42 and 43 respectively extend beyond the outer edges 46 of the aligned layers of puncture resistant fabric 41. The upper and lower layers of foam 42 and 43 are then secured together along the outer peripheries 44 and 45 thereof, outward from the outer edges 46 of the layers of puncture resistant fabric 41, to form a pocket 47 in which the aligned layers of puncture resistant fabric 41 are secured. The upper and lower layers of foam 42 and 43 are shown secured together by stitches 48. The upper and lower layers of foam 42 and 43 generally form a pocket or envelope in which the layers of puncture resistant fabric 41 are secured.

A coating or layer of pressure sensitive adhesive 49 is applied or affixed to a lower surface of the lower layer of foam 43. A removable cover or backing 50 is then removably affixed to the outer surface of the layer of pressure sensitive adhesive 49. The removable backing 50 may be formed from a relatively stiff paper stock coated with a release material such as a polyethylene film. The removable backing 50 is rectangular and sized larger than the insole 40 to prevent or deter insertion of the insole 40 into a shoe or boot without first removing the backing 50. Once the backing 50 is removed, the insole 40 is inserted into the shoe or boot, generally in alignment with the existing insole such that the layer of pressure sensitive adhesive 49 is positioned against the existing insole. The adhesive selected is one that will not fixedly set to a surface upon initial contact but which permits initial adjustment of the insole 40 after insertion, and which then sets and fixes the position of the insole 40 upon application of pressure thereon by the foot of the wearer and over a relatively brief period of wear such as one to eight hours. The adhesive utilized preferably provides a sufficient adhesive bond to prevent removal of the insole 40 after the layer of adhesive 49 sets.

Figure 8:
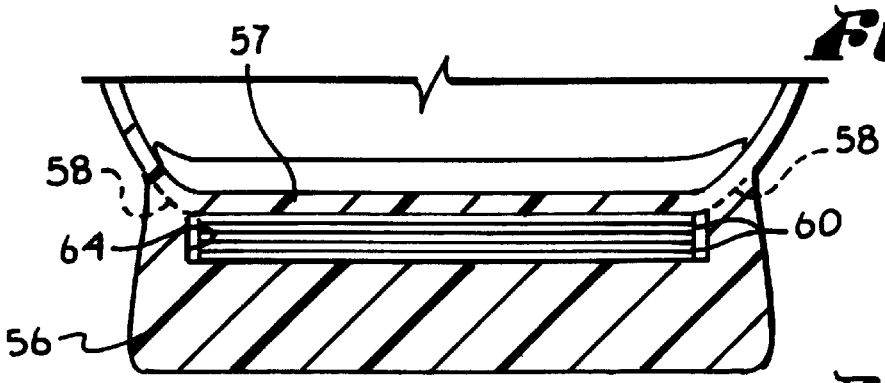
FIG. 8 is an enlarged and fragmentary cross-sectional view taken generally along line 8—8 of FIG. 6.

FIGS. 6 through 8 disclose another alternative embodiment of the present invention particularly adapted for use in water-proof rubber boots 55 including an outer rubber sole 56 and an inner rubber sole 57 which are secured together by vulcanization. The phantom lines 58 in FIGS. 6 and 8 generally indicate where the inner rubber sole 57 has bonded to the outer rubber sole 56 through the vulcanization process. A plurality of layers of puncture resistant fabric 60 are positioned between the outer rubber sole 56 and the inner rubber sole 57 which are each formed from partially cured rubber. As best seen in FIGS. 7 and 8, the layers of puncture resistant fabric 60 are shorter and narrower than the outer and inner rubber soles 56 and 57 such that peripheral edges or surfaces of the outer and inner rubber soles 56 and 57 extend beyond the outer periphery of the layers of puncture resistant fabric 60 and are positioned in contact with one another. During a subsequent curing or vulcanization process the peripheral edges of the outer and inner rubber soles 56 and 57 are bonded together, however, the rubber of the outer and inner rubber soles 56 and 57 does not impregnate the layers of puncture resistant fabric 60 formed from tightly woven high tensile strength synthetic fibers, preferably a 70—70 weave of 200 denier strands of Kevlar® polyaramid fibers. Kevlar® is difficult to burn and does not melt but does decompose at around 7232° Fahrenheit. The vulcanization temperature for the rubber of the boots 55 is approximately 800° Fahrenheit. Therefore, the layers of puncture resistant fabric 60 remain intact during the vulcanization process. A recessed area 64 is preferably formed in the outer rubber sole 56 or the inner rubber sole 57 or both to receive the layers of puncture resistant fabric 60 such that after vulcanization of the inner rubber sole 57 to the outer rubber sole 56 the layers of puncture resistant fabric 60 are generally secured within a pocket. In the embodiment shown in FIGS. 6 through 8 the recessed area 64 is shown formed in the outer rubber sole 56.

It is foreseen that the pocket in which the layers of puncture resistant fabric 60 are secured could be formed from a wide variety of means. For example, it is foreseeable that the layers of puncture resistant fabric 60 could be secured within layers of shrink wrap plastic with sufficient holes formed therein to permit breathability. Whatever the materials utilized to form the pocket for receiving the layers of puncture resistant fabric 60, it is important that the outer peripheries thereof which extend beyond outer edges 46 of the layers of puncture resistant fabric 60 be minimal to ensure that the layers of puncture resistant fabric 60 cover substantially all of the bottom of the wearer's foot.

Testing

Figure 9:
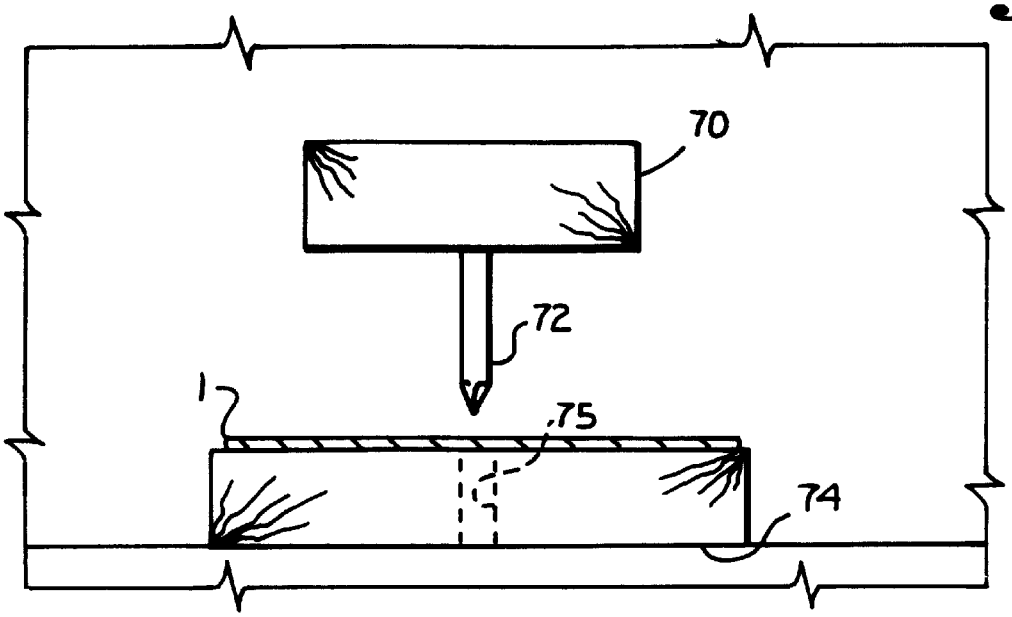
FIG. 9 is a schematic diagram of a testing apparatus for testing the puncture resistance of an insole.

Three pairs of insoles 1 comprising 8 layers, 10 layers and 12 layers respectively of puncture resistant fabric formed from a 70—70 weave of 200 denier strands of Kevlar® polyaramid fibers secured between an upper and lower layer of foam were tested for puncture resistance in accordance with American National Standards Institute Standard Z41-1991, Section 5. FIG. 9 is a representative drawing of the apparatus used for testing as required by American National Standard Z41-1991. The testing standard requires that the testing apparatus includes a moveable platform 70 capable of controlling travel either horizontally or vertically and which is fitted with a steel test pin 72. The insole 1 to be tested is placed on a block 74 at least 0.75 inch thick and having a 0.50 inch diameter hole 75 extending therethrough to allow free passage of the pin 72 as it penetrates through the insole 1 during the test. The rate of travel of the pin 72 is 0.393 + or − 0.039 inches (10 mm + or − 1 mm) per minute. Three tests were made on each insole 1 to be tested in accordance with the above noted procedure.

The results of the test are shown in Table 1 for the three tests conducted on each insole 1. The ultimate load represents the reading at the peak of force when the point of the pin 72 penetrated the sample.

| Sample Thickness | 8 ply | 10 ply | 12 ply |
|---|---|---|---|
| Ultimate Load (lbf.) | 222.2 | 301.4 | 371.8 |
| | 244.2 | 314.6 | 338.8 |
| | 228.8 | 312.4 | 325.6 |
| Average | 231.7 | 309.5 | 345.4 |

When the layers of puncture resistant material are secured within a shoe or boot, the puncture resistance will increase it is believed due to the support provided to the layers of puncture resistant material by the other components of the sole and due to the puncture resistant properties of the other components of the sole.

It is to be understood that the drawings showing the components of the soles and insoles including the layers of puncture resistant material, foam covers and adhesive layers are for representational purposes and not intended to indicate specific relative thicknesses of the various components.

It is to be understood that while certain forms of the present invention have been illustrated and described herein, it is not to be limited to the specific forms or arrangement of parts described and shown.

What is claimed and desired to be secured by Letters Patent is as follows:

1. An insole comprising:

(a) a plurality of layers of puncture resistant fabric formed from a tightly woven high tensile strength polymeric fiber; said layers of puncture resistant fabric being positioned within a pocket formed within one or more layers of flexible material wherein an outer periphery of said pocket extends beyond outer edges of each of said layers of puncture resistant fabric and said pocket is formed between an upper and a lower layer of foam secured together along the outer peripheries thereof beyond said outer edges of each of said layers of puncture resistant fabric.

2. An insole comprising:

(a) at least three layers of puncture resistant fabric formed from strands of polyaramid fiber, each strand of approximately 200 denier or finer, in a weave of approximately 70 strands or more per inch of warp and woof; said layers of puncture resistant fabric being positioned within a pocket formed within one or more layers of flexible material wherein an outer periphery of said pocket extends beyond outer edges of each of said layers of puncture resistant fabric and said pocket is formed between an upper and a lower layer of foam secured together along outer peripheries of said upper and lower layers of foam which extend beyond said outer edges of each of said layers of puncture resistant fabric.

3. In a shoe having a sole, the improvement comprising:

(a) a plurality of layers of puncture resistant fabric formed from a tightly woven high tensile strength polymeric fiber extending across at least a portion of said sole; said layers of puncture resistant fabric being positioned within a pocket formed within one or more layers of flexible material wherein an outer periphery of said pocket extends beyond outer edges of each of said layers of puncture resistant fabric and said pocket is formed between an upper and a lower layer of foam secured together along outer peripheries of said upper and lower layers of foam which extend beyond said outer edges of each of said layers of puncture resistant fabric.

4. In a shoe having a sole, the improvement comprising:

(a) at least three layers of puncture resistant fabric formed from strands of polyaramid fiber, each strand of approximately 200 or lower denier in a weave of approximately 70 strands or more per inch of warp and woof; said layers extending across at least a portion of said sole; said layers of puncture resistant fabric being positioned within a pocket formed within one or more layers of flexible material wherein an outer periphery of said pocket extends beyond outer edges of each of said layers of puncture resistant fabric and said pocket is formed between an upper and a lower layer of foam secured together along outer peripheries of said upper and lower layers of foam which extend beyond said outer edges of each of said layers of puncture resistant fabric.

* * * * *